US005176944A

United States Patent [19]

Striegl et al.

[11] Patent Number: 5,176,944

[45] Date of Patent: Jan. 5, 1993

[54] TEXTILE FASTENER MADE OF FLAME-RESISTANT POLYESTER MONOFILAMENTS

[75] Inventors: Peter Striegl; Wolfgang Maiwald, both of Bobingen, Fed. Rep. of Germany

[73] Assignee: Hoechst Aktiengesellschaft, Fed. Rep. of Germany

[21] Appl. No.: 539,784

[22] Filed: Jun. 18, 1990

[30] Foreign Application Priority Data

Jun. 20, 1989 [DE] Fed. Rep. of Germany ... 8907504[U]

[51] Int. Cl.[5] ..... B32B 3/00

[52] U.S. Cl. ..... 428/99; 428/100; 428/920; 428/921; 24/445

[58] Field of Search ..... 24/445; 528/285; 428/99, 100, 398, 920, 921

[56] References Cited

U.S. PATENT DOCUMENTS 3,594,873 7/1971 Hockmeyer, Jr. ..... 24/204
3,941,752 3/1976 Kleiner et al. ..... 260/75 P

FOREIGN PATENT DOCUMENTS 1809110 4/1960 Fed. Rep. of Germany .
2346787 3/1975 Fed. Rep. of Germany .
3326086 8/1984 Fed. Rep. of Germany .
3513325 10/1986 Fed. Rep. of Germany .

*Primary Examiner*—Patrick J. Ryan
*Assistant Examiner*—Kam F. Lee
*Attorney, Agent, or Firm*—Connolly & Hutz

[57] ABSTRACT

A textile fastener consists of monofilaments (12, 14; 22, 28) made of polyesters which have been formed from dicarboxylic acid and diol components and into which a flame retardant has been incorporated.

The flame retardant is present in the polyester chains as copolymerized elements having the structural units of the general formula where R is alkylene, arylene or aralkylene and $R_1$ is alkyl, aryl or aralkyl.

3 Claims, 1 Drawing Sheet

TEXTILE FASTENER MADE OF FLAME-RESISTANT POLYESTER MONOFILAMENTS

The invention relates to a textile fastener formed from fibers made of linear polyesters.

Textile fasteners such as zip fasteners and touch-and-close fasteners formed from polyester fibers are known. For instance, DE-U-1 809 110 describes a zip fastener whose rows are formed from coil- or meander-like windings of linear polyesters. DE-C-3 326 086 describes a touch-and-close fastener where the hook and loop part consists partly of polyester filaments.

These textile fasteners have little flame resistance. Even though the fastener accounts for only a small proportion of the total weight of the associated article, its low flame resistance can have a critical bearing on the overall flammability rating. Yet flame resistance is becoming more and more important, not least because of legislation.

DE-A-3 513 325 discloses a touch-and-close fastener where, to increase the flame resistance, the hooks of the hook part are formed from wire, while the loops and also the belt of the loop part consist of carbon fibres. Owing to the wire used, however, this touch-and-close fastener is no longer purely textile in character.

Textile fasteners could be rendered flame-resistant by applied finishes. However, applied finishes are costly and may impair the textile character and even the closure force.

The invention has for its object to provide a textile fastener formed from fibers made of linear polyesters which has flame-resistant properties at very little expense.

This object is achieved by the present invention when the fibers are monofilaments made of polyesters which have been formed from dicarboxylic acid and diol components and into which a flame retardant has been incorporated.

Such polyesters, where the property of flame resistance is the result of raw material modification, are known from DE-C-2 346 787. However, the applications mentioned therein are only fibers and filaments for textiles and industrial articles such as tarpaulins, carpets and curtains.

The present invention by contrast proposes for the first time the use of monofilaments made of flame-resistant polyesters for textile fasteners. This has made it possible to render such textile fasteners flame-resistant in a simple manner without need for expensive finishes.

If the textile fastener is a touch-and-close fastener, the diameter of the monofilaments forming the hook and loop parts is advantageously from 0.15 to 0.25 mm. If by contrast the fastener is constructed as a zip fastener, the diameter of the monofilaments is advantageously from 0.45 to 1.20 mm.

The use of monofilaments made of flame-resistance polyesters for textile fasteners proposed by the present invention leaves the advantageous textile properties of the polyester substantially intact.

For instance, the fastener constructed according to the present invention is also notable for a low moisture regain, as a result of which it possesses good dimensional stability and high opening resistance.

Two illustrative embodiments of the invention will be explained with reference to the drawings, where:

FIG. 1 shows a zip fastener 10 having meander-wound monofilaments 12, 14 made of flame-resistant polyesters which have preferably been produced according to the teaching of DE-C-2 346 787.

The monofilaments 12, 14 have a round, preferably circular, cross-section. Their diameter is from 0.45 to 1.20 mm. It will be readily understood that the monofilaments 12, 14 need not have been wound meander-like but could also have been wound helically.

Figure 1:
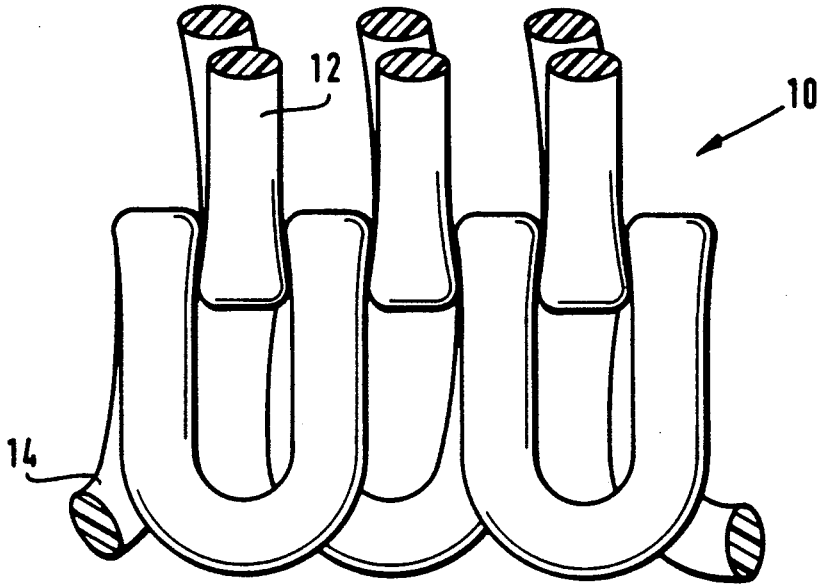
FIG. 1 shows a zip fastener.
Figure 2:
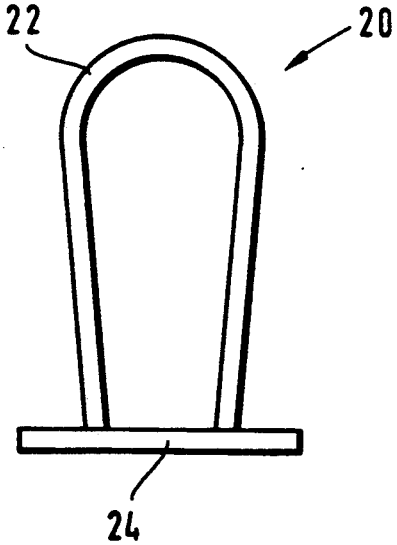
FIG. 2 shows the loop part of a touch-and-close fastener.
Figure 3:
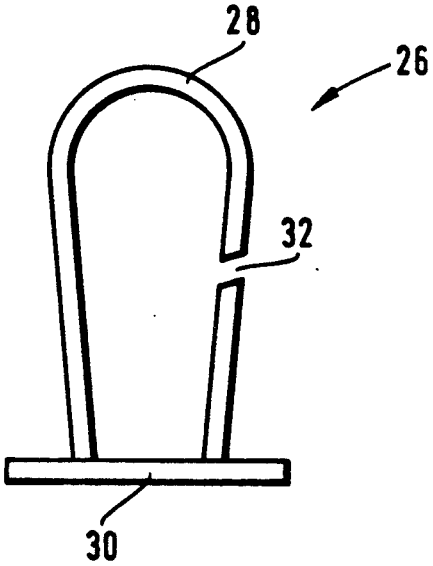
FIG. 3 shows the hook part of the touch-and-close fastener.

FIGS. 2 and 3 are schematic representations of a touch-and-close fastener consisting of a loop part 20 and a hook part 26. The loop part 20 has loops 22, which protrude above a textile belt 24, while the hook part 26 has hooks 28 which protrude above a textile belt 30. The hooks 28 are formed by loops which have been cut open on one side by a cut 32.

The loops 22 of the loop part 20 and the hooks 28 of the hook part 26 are each formed from monofilaments made of flame-resistant polyesters which have preferably been produced according to the teaching of DE-C-2 346 787.

These monofilaments likewise have a round, preferably circular, cross-section. Their diameter is within the range from 0.15 to 0.25 mm.

We claim:

1. A textile fastener made of fibers formed from flame-resistant synthetic fiber material, wherein said fiber material comprises monofilaments having a round cross-section and a diameter in the range of from 0.15 to 0.25 mm and 0.45 to 1.20 mm and consisting of a polyester which has been formed from a dicarboxylic acid and a diol component and which contains copolymerized in its chain elements of the structural formula

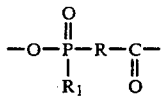

wherein R is saturated open-chain or cyclic alkylene, arylene or aralkylene and R1 is alkyl of 1 to 6 carbon atoms, aryl or aralkyl.

2. The textile fastener as claimed in claim 1, constructed as a touch-and-close fastener, wherein the diameter of the monofilaments (22, 28) forming the hook and loop parts (20, 26) is 0.15–0.25 mm.

3. The textile fastener as claimed in claim 1, constructed as a zip fastener, wherein the diameter of the monofilaments (12, 14) is 0.45–1.20 mm.

* * * * *